US010176954B2

(12) United States Patent
Aubry et al.

(10) Patent No.: US 10,176,954 B2
(45) Date of Patent: Jan. 8, 2019

(54) FRICTIONLESS SWITCHING DEVICE FOR OPENING AND CLOSING AN ELECTRICAL LINE, WITH IMPROVED OPERATING ACCURACY

(71) Applicant: RADIALL, Aubervilliers (FR)

(72) Inventors: Guillaume Aubry, Lyons (FR); Pascal Gonin, Frontonas (FR)

(73) Assignee: RADIALL, Aubervilliers (FR)

( * ) Notice: Subject to any disclaimer, the term of this patent is extended or adjusted under 35 U.S.C. 154(b) by 0 days.

(21) Appl. No.: 15/723,244

(22) Filed: Oct. 3, 2017

(65) Prior Publication Data

US 2018/0025875 A1 Jan. 25, 2018

Related U.S. Application Data

(63) Continuation of application No. 15/266,490, filed on Sep. 15, 2016, now Pat. No. 9,818,566.

(30) Foreign Application Priority Data

Sep. 24, 2015 (FR) ..... 15 59001

(51) Int. Cl.
*H01H 50/64* (2006.01)
*H01H 13/20* (2006.01)
(Continued)

(52) U.S. Cl.
CPC ..... *H01H 50/646* (2013.01); *H01H 1/20* (2013.01); *H01H 3/38* (2013.01); *H01H 13/20* (2013.01); *H01H 50/548* (2013.01)

(58) Field of Classification Search
CPC .... H01H 50/548; H01H 50/646; H01H 13/20; H01H 15/00
(Continued)

(56) References Cited

U.S. PATENT DOCUMENTS 2,472,333 A * 6/1949 Kohl ..... H01H 13/36 200/16 A
3,317,697 A * 5/1967 Bauer ..... H01H 13/06 200/295

(Continued)

FOREIGN PATENT DOCUMENTS

EP 0670579 A1 9/1995
JP 2010-123546 A 6/2010

OTHER PUBLICATIONS

Search Report dated Jun. 16, 2016 for FR 15/59001.
Co-pending U.S. Appl. No. 15/266,490, filed Sep. 15, 2016.

*Primary Examiner* — Shawki S Ismail
*Assistant Examiner* — Lisa Homza
(74) *Attorney, Agent, or Firm* — Pearne & Gordon LLP

(57) ABSTRACT

A switching device for opening and closing an electrical line, including:

two fixed contact terminals separated from one another, an operating member, comprising a contact piece, at least one flexible strip comprising at least one end part attached to a fixed support, the flexible strip or strips being adapted to exert a return force on the contact piece to return it from its closed position to its open position in the absence of a motive force on the operating member, the operating member comprising two electrically insulating pusher arms, spaced apart from one another and each attached to an end part of the contact piece;

each flexible strip comprising two other end parts, each attached to one of the two push arms or to a part of the operating member that is itself attached to, or forms an integral part of, one of the pusher arms.

18 Claims, 10 Drawing Sheets

(51) Int. Cl.
*H01H 50/54* (2006.01)
*H01H 1/20* (2006.01)
*H01H 3/38* (2006.01)

(58) Field of Classification Search
USPC ..... 335/4
See application file for complete search history.

(56) References Cited

U.S. PATENT DOCUMENTS 3,769,474 A * 10/1973 Deubel ..... H01H 5/18 200/447
3,973,094 A * 8/1976 Kuhn ..... H01H 3/001 200/443
4,224,489 A * 9/1980 Dietrich ..... H01H 1/2083 200/16 A
4,345,225 A * 8/1982 Lemmer ..... H01H 50/02 335/132
4,839,483 A * 6/1989 Doyle ..... H01H 1/585 200/275
5,047,740 A 9/1991 Alman
5,528,006 A * 6/1996 Gonin ..... H01H 13/06 200/16 A
6,784,769 B1 8/2004 Chen
8,890,639 B2 * 11/2014 Choi ..... H01H 36/00 335/179
2004/0000980 A1 * 1/2004 Gonin ..... H01H 50/546 335/132
2006/0244555 A1 11/2006 Fabrice et al.

* cited by examiner

FRICTIONLESS SWITCHING DEVICE FOR OPENING AND CLOSING AN ELECTRICAL LINE, WITH IMPROVED OPERATING ACCURACY

CROSS-REFERENCE TO RELATED APPLICATIONS

This application claims the benefit of U.S. non-provisional application Ser. No. 15/266,490, filed on Sep. 15, 2016, which is incorporated herein in its entirety by reference thereto.

FIELD OF THE INVENTION

The present invention relates to a switching device for opening and closing an electrical line, notably a high frequency switch capable of operating equally well with continuous, low, medium or high frequency signals.

BACKGROUND OF THE INVENTION

There are known switching devices for opening and closing an electrical line in which a strip-like contact piece is supported by an operating member that is translationally movable between a position in which said contact piece is applied to two contact terminals, thus closing the electrical line, and a position in which it is separated from said contact terminals, thus opening the electrical line.

During its translational movements, the contact piece is guided by rods along which it slides, to ensure the correct application of said contact piece against the contact terminals.

However, this guidance has the drawback that the friction occurring between the contact piece and its guide rods gives rise to dust that may be deposited on the electrical contact surfaces and may, in the long term, degrade the reliability of the switching device.

The applicant has proposed an improved solution to overcome these drawbacks, as described in patent EP 0670579B1. This solution is generally satisfactory for a large number of applications, since it proposes a switching device that can eliminate friction in the operating member. However, it may be unsuitable for applications at microwave frequencies of more than 40 GHz, for which the switching device, when in the closed position, must be capable of allowing signal transmission in the microwave frequency range above several tens of GHz, for example up to 60 GHz. This is because, in the disclosed switching device, some clearance may remain in the guidance of the push member, which gives rise to play at the end of the contact strip. Although this play is acceptable for most applications, since contact does in fact take place between the contact strip and the upper surface of the two contact terminals when the switch is closed, it may be unacceptable when the signals to be switched are very high frequency signals.

Consequently there is a need to improve switching devices for opening and closing an electrical line, notably with the aim of providing effective transmission of signals in the hyperfrequency (HF) range above 40 GHz in the closed position.

BRIEF SUMMARY OF THE INVENTION

The general object of the invention is to provide a partial response to this requirement.

A specific object is to propose a solution that responds to the general object and that may be applied to any HF component incorporating a switching device, such as a miniature relay, more particularly an SPDT (for the English term "Single Pole Double Throw") relay, or more generally an nPnT ("n Poles, n Throw") relay, while being simple, reliable and inexpensive.

Thus the invention proposes, according to one aspect, a switching device for opening and closing an electrical line, comprising:

two fixed contact terminals separated from one another, an operating member, comprising a contact piece adapted to be moved axially between a closed position in which the contact piece is applied simultaneously to the two contact terminals, connecting them electrically, and an open position in which the contact piece is separated from the two contact terminals, and at least one flexible strip comprising at least one end part attached to a fixed support, the flexible strip or strips being adapted to exert a return force on the contact piece to return it from its closed position to its open position in the absence of a motive force on the operating member.

According to the invention, the operating member comprises two electrically insulating pusher arms, spaced apart from one another and each attached to an end part of the contact piece, and each flexible strip comprises two other end parts, each attached to one of the two push arms or to a part of the operating member that is itself attached to, or forms an integral part of, one of the pusher arms.

Thus the invention essentially consists in providing the operating member with two pusher arms, which may be spaced apart from one another by a maximum distance relative to the length of the contact piece, which are supported by the flexible strip or strips, and which are placed in the end part of the flexible strip or strips whose degree of deformation may be maximal along the axis of movement of the operating member.

The two pusher arms, being spaced apart from one another by a distance substantially equal to the length of the contact piece, cause the contact piece to move by bearing simultaneously on the two end parts of the contact piece. Advantageously, the two pusher arms are spaced apart from one another by a distance of at least 3 millimetres.

Because of these two pusher arms attached to the ends of the contact piece, which is advantageously a rigid flat strip, the accuracy of the rotational positioning of the operating member relative to the fixed support(s) of the flexible strip or strips is considerably increased by comparison with the prior art solutions, notably that of the patent EP 0670579B1.

In fact, owing to the support by the flexible strip or strips and their considerable degree of separation, the two pusher arms are correctly guided axially by the flexible strip or strips, this being achieved without friction against the surrounding fixed elements, notably against a closure plate that separates the contact terminals from the greater part of the device.

In other words, there is an increase in the accuracy of the positioning of the flexible strip or strips which cause the axial movement of the pusher arms supported by them, and consequently the accuracy of the guidance of the contact piece relative to the fixed contact terminals is also increased.

By increasing the accuracy of the positioning of the contact piece on the fixed contact terminals through which the hyperfrequency signals are transmitted, the risk of misalignment between these pieces is reduced, thereby allowing the transmission of signals in the hyperfrequency (HF)

range, that is to say at frequencies of between 1 GHz and several tens of GHz, for example up to 60 GHz.

According to an advantageous embodiment, the switch comprises two flexible strips kept spaced parallel to one another on each fixed support as well as on each of the two pusher arms or each part of the operating member, which is itself attached to, or forms an integral part of, one of the pusher arms. Using two flexible strips, there is a further increase in the accuracy of the axial movement without rotation of the pusher arms, and consequently in the accuracy of the positioning of the contact piece on the contact terminals for closing the electrical line.

According to an advantageous variant embodiment, the contact piece is a rigid flat strip, and each of the two pusher arms is of straight elongate shape and is attached to the rigid flat strip and orthogonal thereto.

The operating member may advantageously be a single piece consisting of a rod connected to a connecting beam connecting the two pusher arms, or alternatively may consist of the two pusher arms only.

According to an advantageous variant, each other end part of the at least one flexible strip is attached to each of the two pusher arms, or to each part of the operating member which is itself attached to, or forms an integral part of, one of the pusher arms, by a removable joint, preferably a bearing and centring joint or a clip-fitting joint. Any other permanent joint solution, such as ultrasonic welding or another method, is also feasible.

According to another advantageous variant, the contact piece is attached to the two pusher arms by a removable joint, preferably a clip-fitting joint. Any other permanent joint solution, such as ultrasonic welding or a mortice and tenon joint with flattening of material as described in the patent EP0670579B1, or another method, is also feasible.

In the clip-fitting variant, the contact piece preferably comprises two openings, each formed in one of its end parts, and the two pusher arms comprise hooks that can each engage in one of the two openings of the contact piece so as to form a removable joint. This assembly solution is simple and reliable, and also facilitates the mounting of the flexible strips on the pusher arms before the contact piece is clipped on. The attachment may also be supplemented by one or more welds.

According to an advantageous characteristic, each fixed support comprises a shaft arranged parallel to the axis of movement of the operating member. Preferably, the shaft of the support is arranged substantially orthogonally to the rigid flat contact strip. This further increases the accuracy of the axial movement of the pusher arms. More generally, the fixed supports that are the bearing points of the flexible operating strips may be made in any shape and may be arranged at any location in the switch, according to the installation constraints. They are preferably fixed on a reference plane of the switching device, for example on the body of a relay in which the switching device is incorporated. The aim is to space these fixed supports of the pusher arms as far apart as possible, to ensure the optimal angular positioning of the contact piece. A flexible operating strip may be supported by a single support, or two or more fixed supports.

In an advantageous embodiment, the operating member is moved by means of an axially moving actuator adapted to move at least one flexible strip, called the drive strip, arranged substantially orthogonally to the axis of movement of the operating member and adapted to transmit the movements of the actuator to the two pusher arms.

The interposition of a flexible drive strip between the actuator and the operating member has the advantage that any separation due to axial play between the actuator and the operating member may be compensated by a deformation of the flexible drive strip. This is because, if the actuator transmitted an axial movement directly to the pusher arms over a trajectory exceeding the length between its open and closed positions, this could cause damage to the pusher arms or the actuator.

Conversely, if the actuator transmitted an excessively small movement to the pusher arms, this could result in a poor application of the contact piece to the contact terminals and an imperfect closure of the electrical line. Because of the presence of a flexible drive strip between the actuator and the pusher arms, it is possible to deliberately use an actuator having excessive axial play relative to the trajectory to be followed by the pusher arms, in order to ensure that the latter are moved along a sufficient trajectory to ensure good electrical contact, while safeguarding the operating member and the actuator from any risk of damage.

According to a first variant, if the operating member is made with a rod and a connecting beam between the pusher arms, the device may comprise a single flexible drive strip having a free end bearing against the rod of the operating member, to transmit the movements of the actuator to the two pusher arms.

According to a second variant, if the operating member comprises only the two pusher arms, the device may comprise two flexible drive strips, each having a free end bearing against one of the two pusher arms for transmitting the movements of the actuator to them.

According to an advantageous embodiment, the switching device comprises an electrically conductive closure plate, the contact piece of the operating member and the two contact terminals being arranged on one side of said closure plate, while the greater part of the two pusher arms, together with the flexible strip or strips and the fixed support or supports are arranged on the other side of the closure plate.

According to an advantageous characteristic, the closure plate comprises two openings, each allowing the passage and frictionless axial movement of one of the two pusher arms. In fact, owing to the perfect guidance of the pusher arms by the flexible strip or strips, the design and relative arrangement of the openings ensure that no friction occurs between the pusher arms and the closure plate, regardless of the number of switching actions performed during the life of the switching device.

Advantageously, in the open position of the operating member, the contact piece bears on the closure plate. This avoids any risk of coupling between the two contact terminals in this open position.

According to a first advantageous embodiment, each flexible strip has an external shape substantially in the form of an isosceles triangle or a parallelogram, comprising a single end part attached to a fixed support arranged on one side of the plane formed by the two pusher arms and extending orthogonally to the contact piece, each other end part of each flexible strip being attached to one of the two pusher arms. This first configuration may be provided, notably, in cases in which the space constraints are severe, since the arrangement of the flexible operating strip or strips on a single side of the plane of the pushers releases space on the other side.

According to a second advantageous embodiment, each flexible strip has an external shape substantially in the form of a lozenge, comprising two end parts attached to a fixed support arranged in a plane perpendicular to the plane formed by the two pusher arms and extending orthogonally to the contact piece, each other end part of each flexible strip being attached to one of the two pusher arms or to part of the operating member attached to the two pusher arms, forming a cross. This configuration may, for example, be used if the operating member is formed solely by the two pusher arms, the flexible strip or strips being made to bear directly against the pusher arms.

According to a third advantageous embodiment, each flexible strip is in the general shape of a lozenge, comprising two end parts, each attached to a fixed support arranged in the plane formed by the two pusher arms and extending orthogonally to the contact piece, each other end part of each flexible strip being attached to one of the two pusher arms.

According to a fourth advantageous embodiment, each flexible strip has an external shape substantially in the form of a lozenge, comprising two end parts, each attached to a fixed support arranged in the plane formed by the two pusher arms and extending orthogonally to the contact piece, each other end part of each flexible strip being attached to a part of the operating member attached to the two pusher arms, forming a cross.

The lozenge configurations enable a very high accuracy of movement of the contact piece to be achieved, while allowing high pushing forces on the pusher arms and providing very good compactness.

They allow a compact arrangement, notably a radial arrangement, of a plurality of switches on the same support, closed by a single closure plate, notably for switches of the SPnT type.

BRIEF DESCRIPTION OF THE DRAWINGS

The invention may be more clearly understood from a perusal of the following detailed description of non-limiting exemplary embodiments of the invention, and from an examination of the attached drawing, in which.

DESCRIPTION OF EXAMPLE EMBODIMENTS

Figure 1:
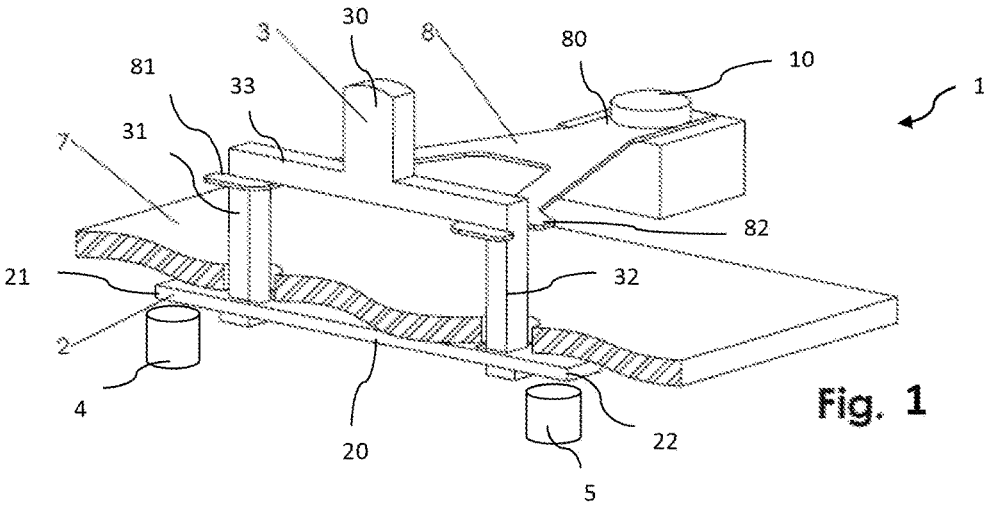
FIG. 1 shows a partially cut-away perspective view of a switching device according to a first embodiment of the invention, in the open position.

Throughout the present application, the terms "lower", "upper", "vertical", "bottom", "top", "below" and "above" are to be interpreted with reference to a switching device in which the operating member is above the contact terminals with the axis of movement of the operating member arranged vertically.

The switching device for opening and closing an electrical line shown in the drawing comprises an operating member 1, which comprises an electrically conductive contact piece 2 and an electrically insulating operating member 3.

As illustrated for all the embodiments, the contact piece 2 advantageously takes the form of a rigid flat metal strip, substantially rectangular in shape. As illustrated, the contact strip 2 comprises a central part 20 and two end parts 21, 22 on either side of the central part 20. Other geometries of the contact piece may be equally suitable.

The contact piece 2 is adapted to bear simultaneously on two contact terminals 4, 5, fixed and separate from one other, and having contact surfaces 4*a*, 5*a*, located in the same plane parallel to the contact piece 2. HF signals may be transmitted through the two contact terminals 4, 5.

Figure 3:
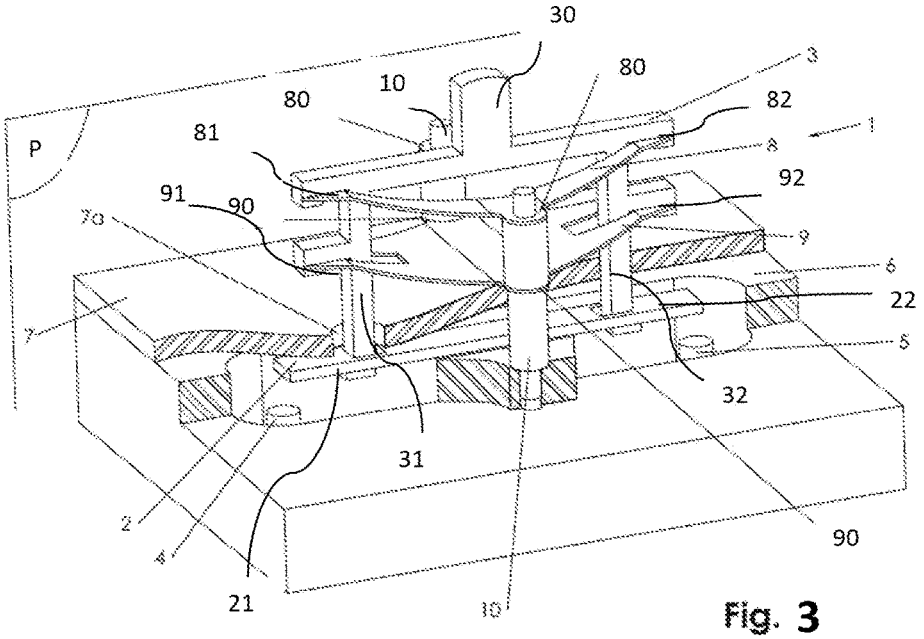
FIG. 3 shows a partially cut-away perspective view of a switching device according to a second embodiment of the invention, in the open position.
Figure 3A:
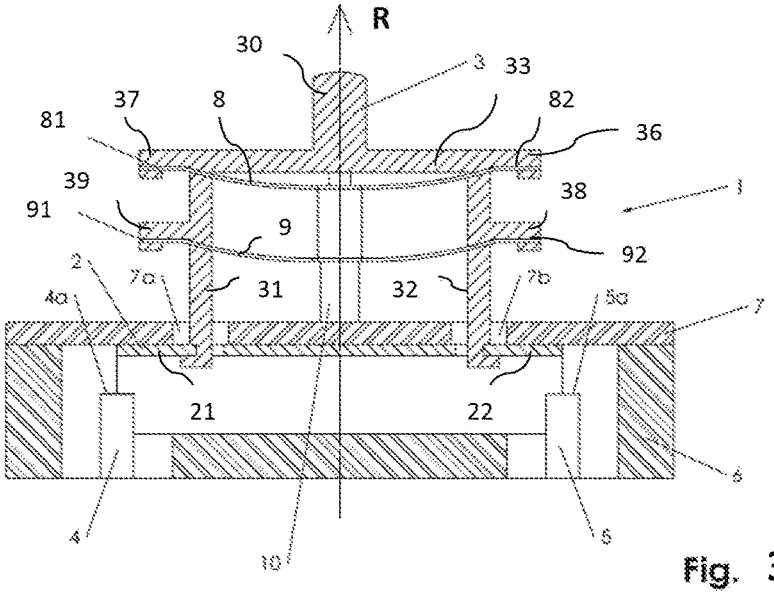
FIGS. 3A and 3B are views in longitudinal section along the plane P of the device of FIG. 3, in the open and closed position respectively.
Figure 3B:
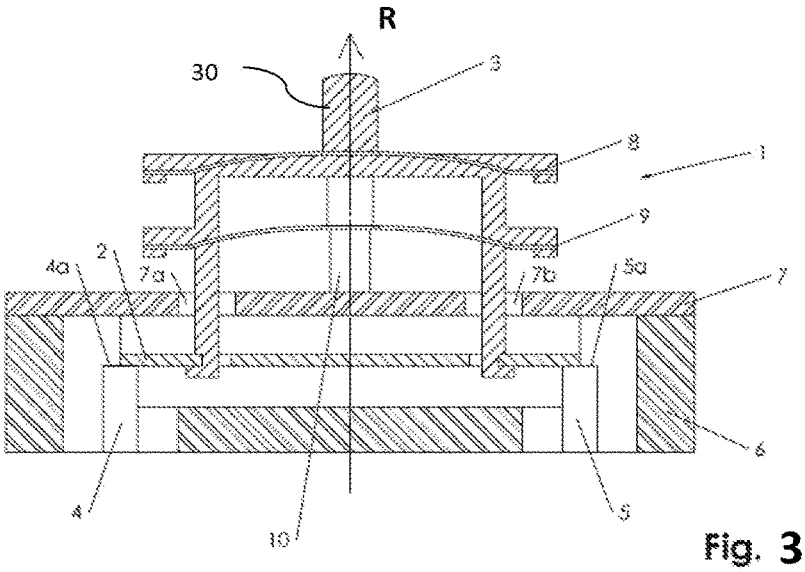

As is clearly shown in FIGS. 3, 3A and 3B, each of the contact terminals 4 and 5 is located in a housing formed for this purpose in an electrically conductive body 6, at a distance from the wall of the housing, said terminals being electrically insulated from said body. The conductive body 6 comprises an electrically conductive closure plate 7 in which are formed two openings 7*a*, 7*b*, each allowing the passage and movement of one of the two pusher arms 31, 32 of the operating member 3 according to the invention.

The electrical line formed by the two contact terminals 4, 5 and the contact piece 2 is thus protected against any electromagnetic radiation external to the switching device.

According to the invention, the operating member 3 is attached to at least one flexible strip 8, or preferably two flexible strips 8 and 9 kept spaced parallel to one another. Each of the flexible strip or strips 8, 9 is adapted to exert a return force on the contact piece 2 to return it from its closed position, as shown in FIG. 3B, to its open position in the absence of a motive force on the operating member, as shown in FIG. 3A.

Figure 2:
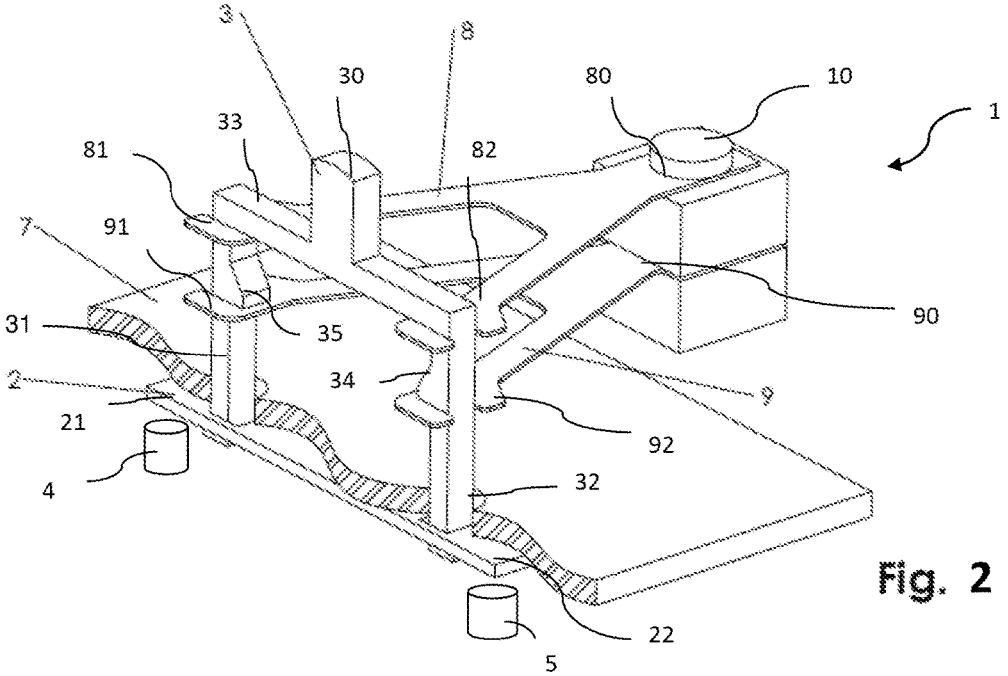
FIG. 2 is a partially cut-away perspective view of a variant of the device according to FIG. 1.

The general external shape of a flexible strip 8, 9 is preferably either an isosceles triangle as shown in FIGS. 1 and 2, or a lozenge as shown in FIGS. 3, 3A, 3B, 4, 7A, 7B, 8A and 9A. Other shapes may be suitable.

Each flexible strip 8, 9 comprises at least one end part 80, 90 attached to a fixed support 10. As illustrated in all the embodiments, a fixed support is preferably a shaft 10 arranged parallel to the axis of movement of the operating member 3, and preferably also arranged substantially orthogonally to the rigid flat contact strip 2.

Each shaft 10 preferably has a shoulder at its lower end and is mounted so as to bear with its shoulder in a hole formed in the conductive body 6.

As shown in FIGS. 3, 7, 7A, 7B, 8 and 9, each shaft 10 may also have a shoulder in a central part and/or at its upper end, so that the end part of a flexible strip 8, 9, preferably in the form of a hole, is mounted solely by fitting around the shaft, and by bearing against the shoulder.

Other attachment solutions may equally well be provided. For example, as shown in FIGS. 1 and 2, ultrasonic welding of the shaft 10 around an end part 80, 90 may be provided.

It is also possible to provide positive connections with grooves on the support, enabling an end part of the flexible strip to be placed inside a groove and to be immobilized by its dimensions which are very slightly smaller than those of the groove. In this case, however, each end part 80, 90 may be free to emerge from a groove in which it is housed.

According to the invention, the operating member 3 comprises two electrically insulating pusher arms 31, 32, spaced apart from one another and each attached to an end part 21, 22 of the contact piece 2. The two pusher arms 31, 32 are advantageously each of straight elongate shape and attached to the rigid flat contact strip 2 while being orthogonal thereto.

In the embodiment shown in FIGS. 1 to 6 and 8 to 9, the operating member is a single piece consisting of a rod 30 connected to a connecting beam 33 connecting the two pusher arms 31, 32. Preferably, the identical pusher arms 31, 32 are arranged symmetrically on either side of the axis X of the rod 30.

Figure 7:
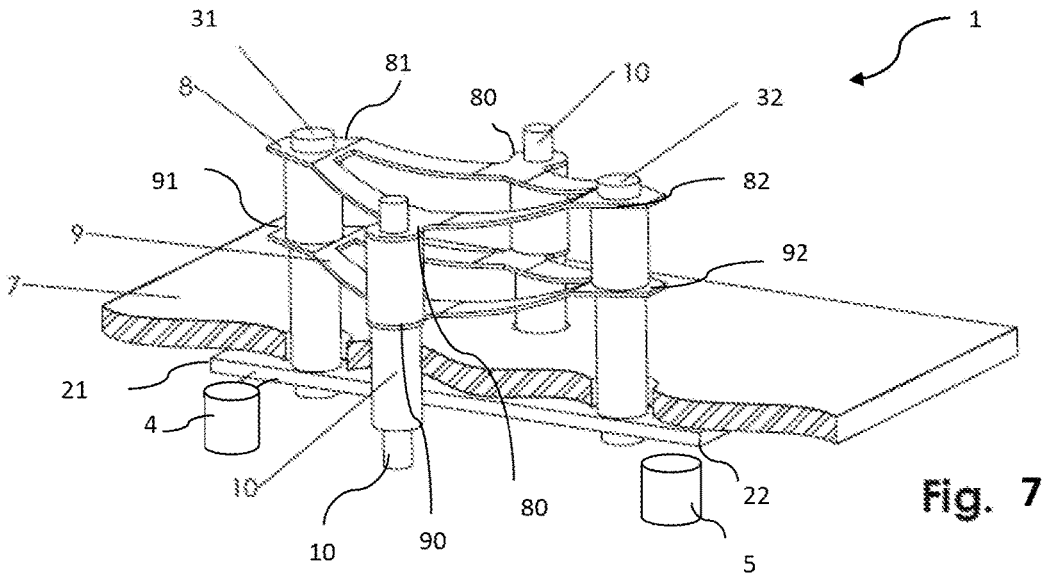
FIGS. 7, 7A and 7B show, in a partially cut-away perspective view, in a top view and in a longitudinal sectional view respectively, a variant of the switching device according to the second embodiment.
Figure 7A:
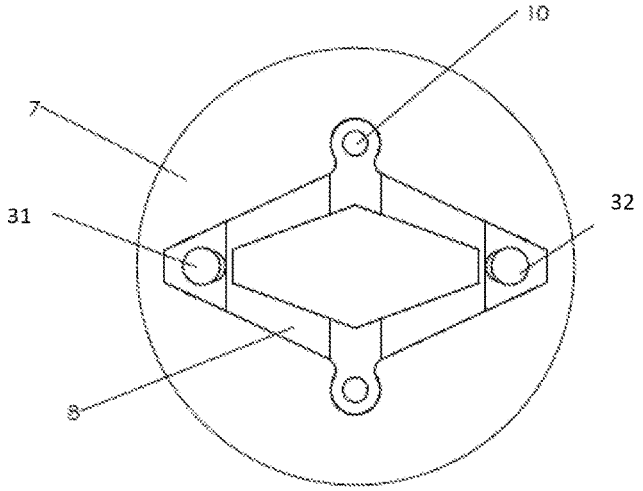
Figure 7B:
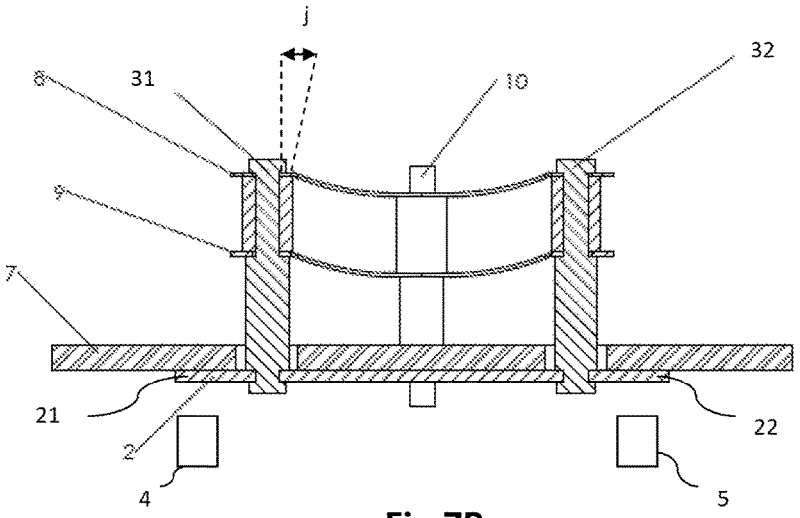

In the embodiment shown in FIGS. 7, 7A and 7B, the operating member consists solely of two pusher arms 31, 32.

The contact piece 2 may be attached to the two pusher arms 31, 32 by a removable joint, preferably a clip-fitting joint. The connection may also be permanent, as in the case of ultrasonic welding, for example. As shown more fully in FIGS. 5 and 6, the proposed clip-fitting may be provided by hooks 31*a*, 32*a* formed at the lower ends of the arms 31, 32, each being clip-fitted into one of the two openings 21*a*, 22*a* formed in the contact strip 2.

Additionally, according to the invention, each flexible strip 8, 9 comprises two other end parts 81, 82 and 91, 92, each attached to one of the two pusher arms 31, 32 or to a part 36, 37; 38, 39; 300 of the operating member that is itself attached to, or forms an integral part of, one of the pusher arms. Preferably, this attachment is provided by a removable joint, preferably a bearing and centring joint of the mortise and tenon type. The joint may, if necessary, be provided by clip-fitting. However, other solutions, such as ultrasonic welding, are feasible.

Figure 5:
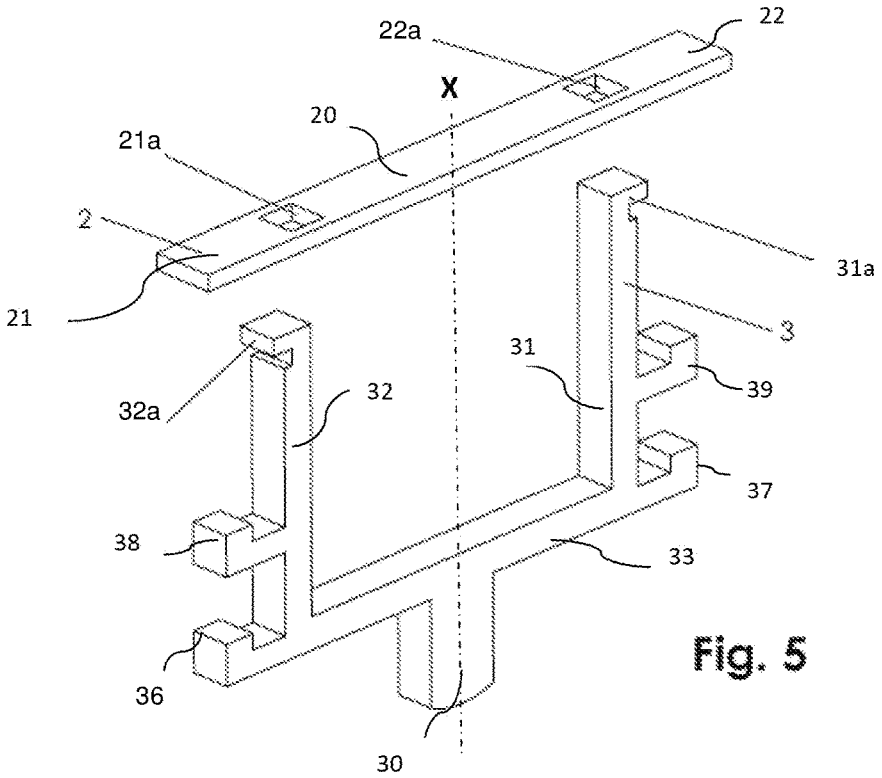
FIGS. 5 and 6 show perspective views of an operating member with its pusher arms according to the invention, respectively before and after the fixing of the contact piece by clip-fitting, the operating member being shown in a configuration which is the inverse of its operating configuration in which the contact strip is at the bottom.
Figure 6:
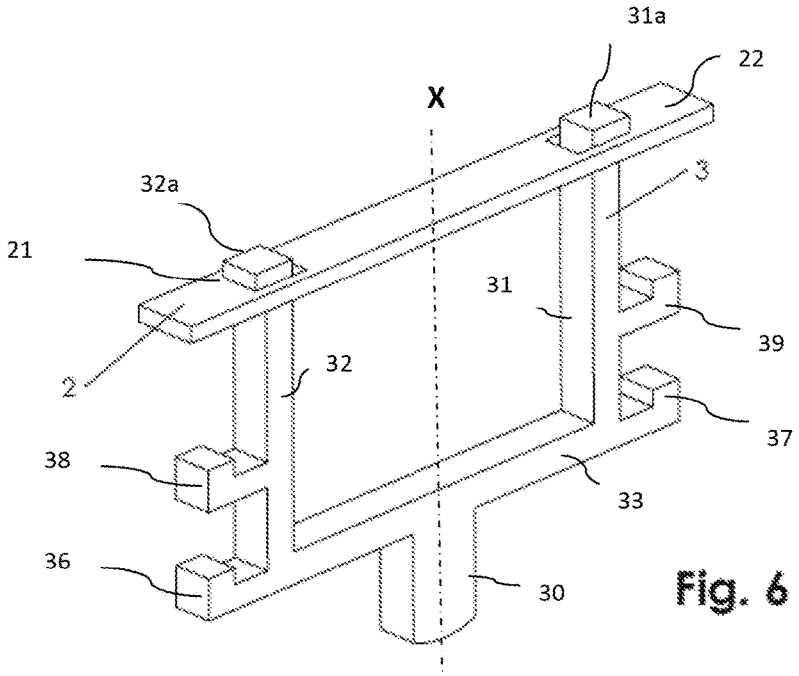

In the embodiment shown in FIGS. 1 and 2, the end parts 81, 82; 91, 92 are directly centred in, and bear inside, pusher arms 31, 32. The centring and bearing may also take place outside the pusher arms as shown in FIGS. 5 and 6.

In the embodiment shown in FIGS. 7, 7A and 7B, the end parts 81, 82; 91, 92 are directly centred on, and bear around, pusher arms 31, 32. As can be seen more clearly in FIGS. 7A and 7B, an operating play j is advantageously provided between the hole forming the end part 81, 82; 91, 92 of each flexible strip 8, 9 and the corresponding pusher arm 31, 32, so that the latter does not interfere with the deformation of the strip 8, 9 during switching.

Figure 8:
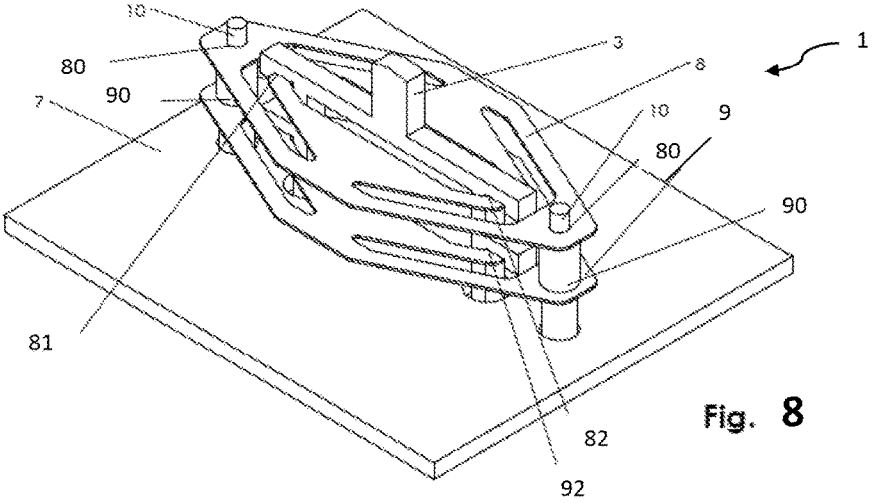
FIGS. 8 and 8A show, in a perspective view and in a top view respectively, a switching device according to a third embodiment of the invention.
Figure 8A:
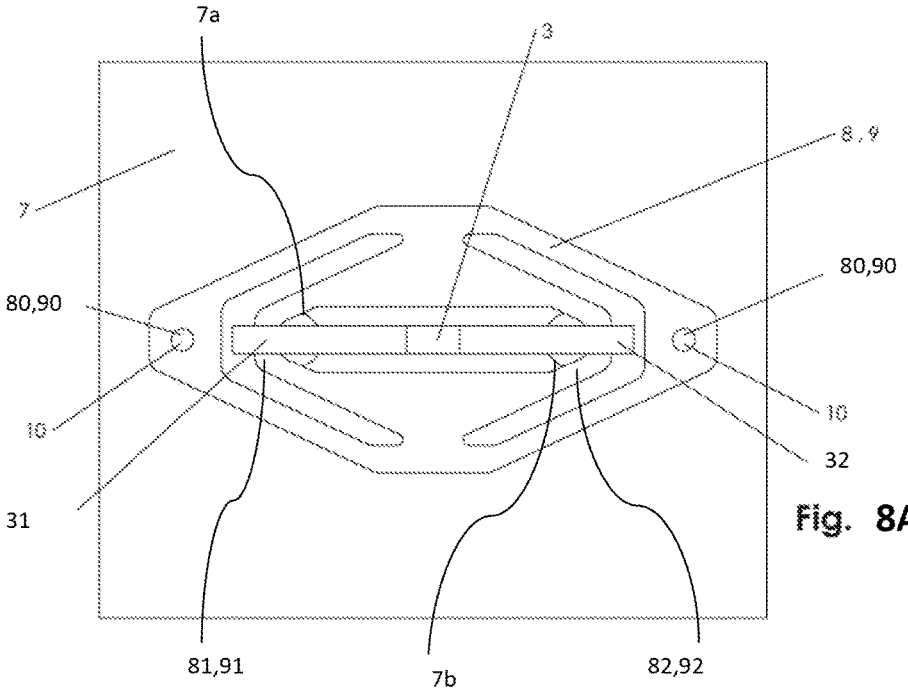

In the embodiment shown in FIGS. 3 to 6, and in FIGS. 8 and 8A, the end parts 81, 82; 91, 92 are clipped on to clipping protrusions 36, 37, 38, 39 which extend radially from the pusher arms 31, 32.

Figure 9:
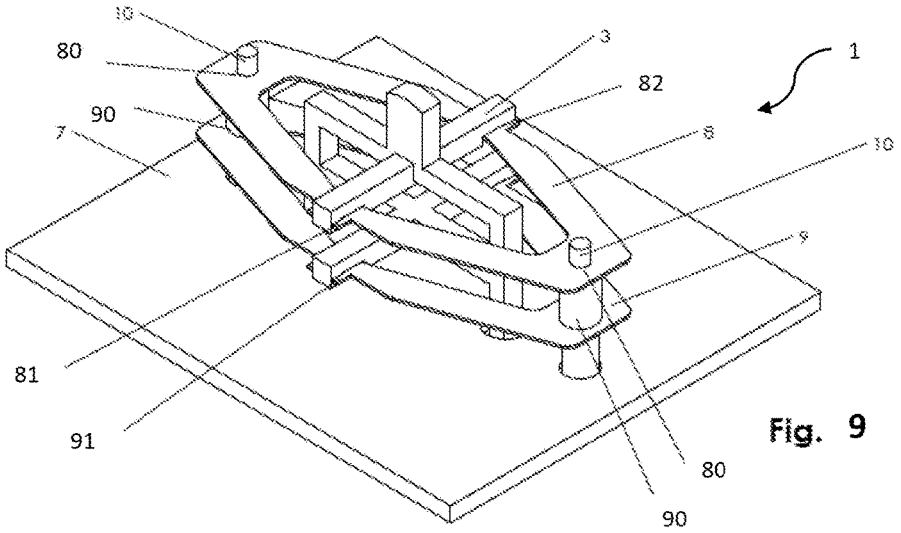
FIGS. 9 and 9A show, in a perspective view and in a top view respectively, a switching device according to a fourth embodiment of the invention.
Figure 9A:
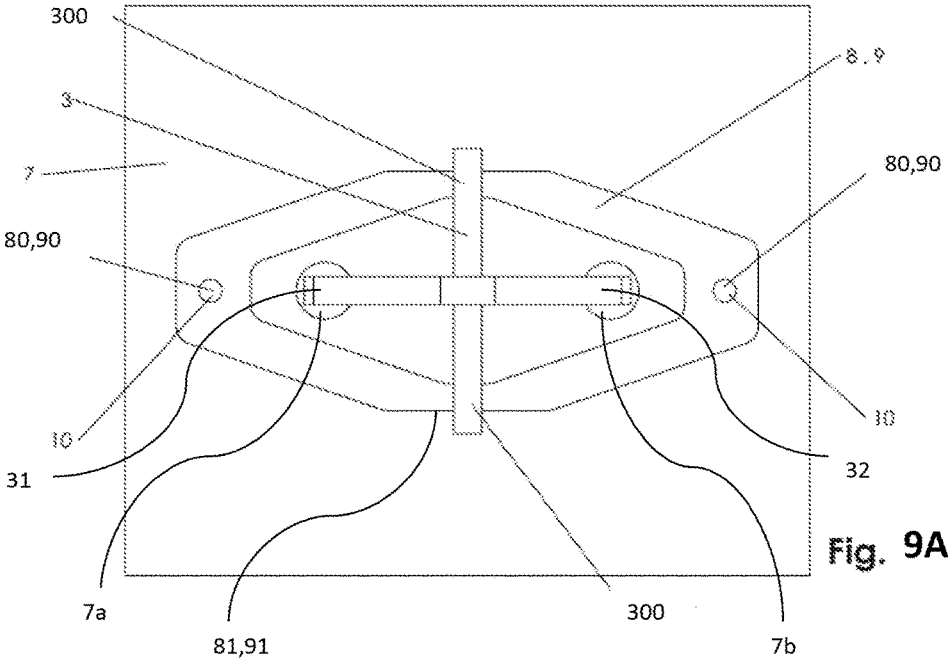

In the embodiment shown in FIGS. 9 and 9A, the end parts 81, 82; 91, 92 are held on a connecting beam 300 forming a cross with the single piece 3 consisting of the rod 30 connected to a connecting beam 33 connecting the two pusher arms 31, 32.

Being supported by the strips 8 and 9, the two pusher arms 31, 32 are correctly guided, since they can only move with an axial translational movement during which the flexible strip or strips 8, 9 flex while remaining parallel to one another.

The flexible strips may be kept parallel to one another on the support shafts 10 by a spacer formed on the shaft itself by a change in diameter, or by a spacer adjusted on, or force-fitted on to, the shaft 10.

The flexible strips may be kept parallel to one another on the pusher arms 31, 32 by protrusions 34, 35 as shown in FIG. 2, or simply by the design of the spacing of the clip-fitting means between the hooks 36, 38 and 37, 39, as shown in FIGS. 3, 3A, 3B and 5, 6.

Because of the two pusher arms 31, 32 according to the invention, which are held by the flexible strips and are attached to the end parts 21, 22 of the contact strip 2, very high accuracy is achieved in the rotational positioning of the operating member 3 relative to the fixed support(s) 10 of the flexible strip or strips 8, 9.

Consequently, the accuracy of the positioning of the flexible strip or strips which cause the axial movement of the pusher arms supported by them is very good, and the accuracy of the axial guidance of the contact piece relative to the fixed contact terminals 4, 5 is therefore also very good.

FIG. 3A shows a switching device according to the invention in the open position of the operating member 3, the contact piece 2 being separated from the contact terminals 4 and 5.

In this embodiment, the flexible strips 8, 9 have been pre-shaped during manufacture with a bend corresponding to that shown in FIG. 3A. Thus the flexible strips 8, 9 constantly exert a force on the pusher 3, along its axis of movement in the direction indicated by the arrow R in FIG. 3B. The pusher arms 31, 32 transmit this force to the contact piece 2, which is thus suitably applied against the closure plate 7. In other words, in this position the pusher arms 31, 32 are located, for practical purposes, above the closure plate 7, with the contact strip 2 bearing against the lower face of the plate. Thus the contact piece 2 is prevented from creating a coupling between the contact terminals 4 and 5 in the open position of the operating member 3.

In the position of the switching device shown in FIG. 3B, the pusher arms 31, 32 are located in the closed position of the operating member, the contact piece 2 being applied against the contact terminals 4 and 5.

An actuator 11, for example an electromagnetic actuator, is capable of moving along an axis parallel to that of the pusher arms 31, 32.

Figure 4:
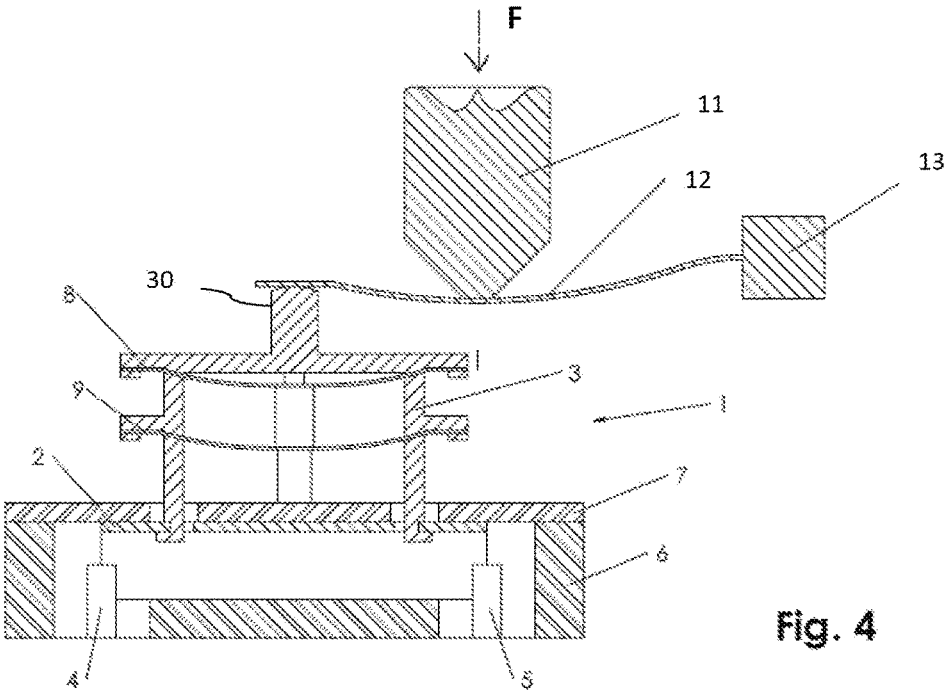
FIG. 4 shows, in longitudinal section, the switching device according to FIG. 3 in the open position, this figure showing the actuator with the movement driving strip of the operating member.

If the operating member 3 comprises a rod 30 with a connecting beam 33 between the pusher arms 31, 32, as shown in FIG. 4, a single drive strip 12 is provided, this strip having a free end attached to a support 13 and running across the lower end of the actuator 11. The other free end of the drive strip 12 bears against the free end of the rod 30.

If the operating member 3 consists solely of the two pusher arms 31, 32, as shown in FIG. 7, two drive strips may be provided, each having a free end bearing against the upper end of one of the two pusher arms 31, 32.

The drive strip or strips 12 are capable of transmitting to the pusher arms 31, 32, directly or indirectly via the rod 30, the translational movements of the actuator 11 in the direction of the arrow F shown on FIG. 4, to move the operating member 1 to its closed position.

Conversely, when the actuator 11 moves in the opposite direction to that of the arrow F shown on FIG. 4, the drive strip 11 releases the pusher arms 31, 32 and moves slightly away from them, enabling the pre-bent flexible strips 8, 9 to return the pusher arms 31, 32 to the open position. As explained above, the presence of the drive strip or strips 2 makes it possible to use an actuator 11 whose axial play is slightly too large as compared with that of the operating member 3, enabling an optimal contact to be made between the contact terminals 4, 5 and the contact piece 2.

An anti-rotation connection may advantageously be provided between the pusher arms 31, 32 and the flexible operating strips 8, 9, by making the connecting beam 33 with a minimal length, or by providing a minimal distance between the arms 31, 32, so as to minimize the separation of the two connecting points between the end parts 81, 82 or 91, 92 of the flexible strips and the pusher arms 31, 32, thereby further improving the rotational positioning of the contact piece 2.

For the production of a piece of switching equipment such as an SPnT switch, incorporating a plurality of switching devices according to the invention, different variant arrangements may be used.

Figure 10:
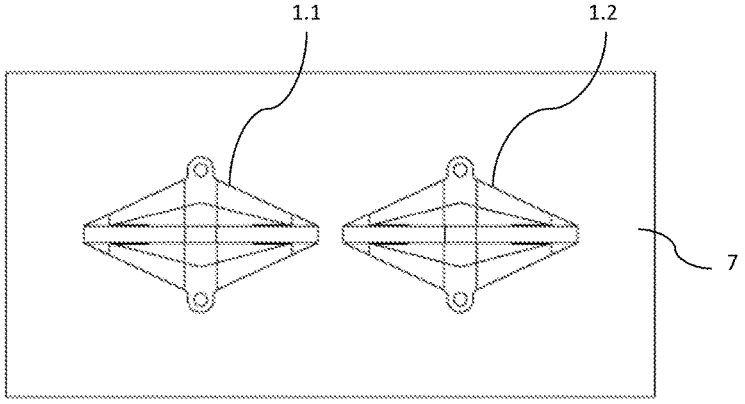
FIG. 10 shows, in a top view, a variant arrangement of two switching devices according to the invention, in which the connecting beams of the pusher arms of the devices are aligned with one another.

For example, as shown in FIG. 10, it is possible to provide two identical switching devices 1.1, 1.2 adjacent to one another with all the pusher arms 31, 32 arranged in the same plane.

Figure 11:
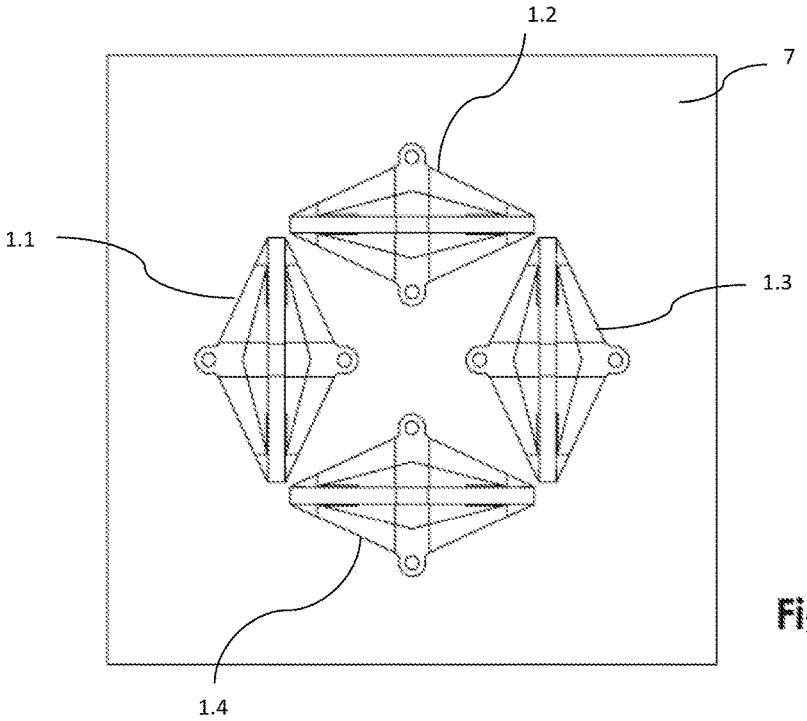
FIG. 11 shows, in a top view, a variant arrangement of four switching devices according to the invention, in which the connecting beams of the pusher arms of the devices are parallel in pairs, forming a square.

In the configuration of FIG. 11, four identical switching devices 1.1, 1.2, 1.3, 1.4 are arranged with the connecting beams 33 of the pusher arms parallel to one another in pairs, thus forming a square.

Figure 12:
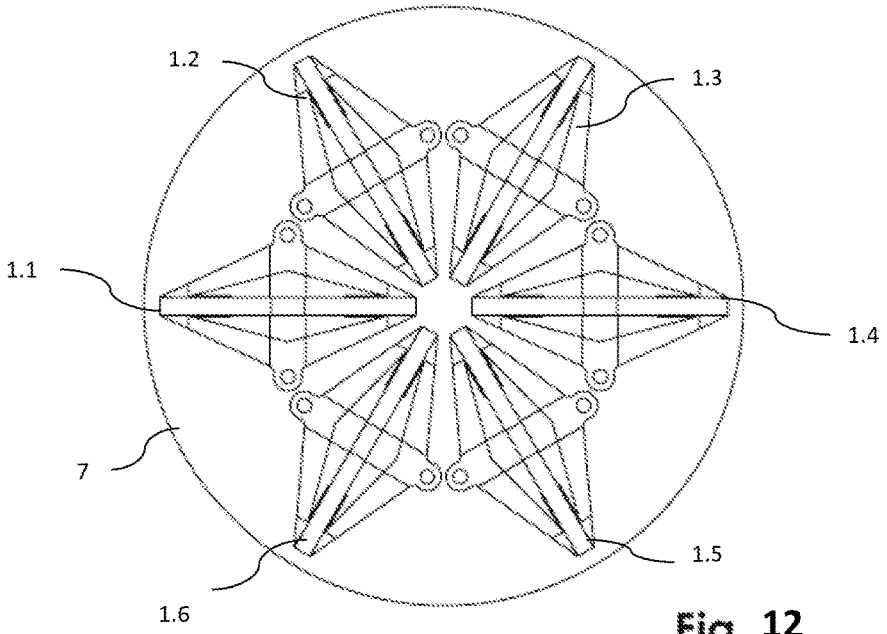
FIG. 12 shows, in a top view, a variant arrangement of six switching devices according to the invention, in which the connecting beams of the pusher arms of the devices are arranged radially about an axis to form a star.

In the configuration of FIG. 12, six identical switching devices 1.1 to 1.6 are arranged with the connecting beams 33 of the pusher arms placed radially about an axis, thus forming a square. This configuration is advantageous in that it allows a high degree of compactness to be achieved, notably for an SPnT switch.

Clearly, the invention is not limited to the exemplary embodiments described above.

Other variants and improvements would be feasible without departure from the scope of the invention.

The invention claimed is:

1. A switching device for opening and closing an electrical line, comprising:

two fixed contact terminals separated from one another, an operating member, comprising a contact piece adapted to be moved axially between a closed position in which the contact piece is applied simultaneously to the two contact terminals, connecting them electrically, and an open position in which the contact piece is separated from the two contact terminals, at least one flexible strip comprising at least one end part attached to a fixed support, the flexible strip or strips being adapted to exert a return force on the contact piece to return it from its closed position to its open position in the absence of a motive force on the operating member, wherein the operating member comprises two electrically insulating pusher arms, spaced apart from one another and each attached to an end part of the contact piece, and wherein each flexible strip comprises two other end parts, each attached to one of the two push arms or to a part of the operating member that is itself attached to, or forms an integral part of, one of the pusher arms;

wherein the device comprises an electrically conductive closure plate, the contact piece of the operating member and the two contact terminals being arranged on one side of said closure plate, while a greater part of the two pusher arms, together with the flexible strip or strips and the fixed supports, are arranged on the other side of the closure plate;

wherein the closure plate comprises two openings, each allowing the passage and frictionless axial movement of one of the two pusher arms.

2. The switching device according to claim 1, wherein it comprises two flexible strips kept spaced parallel to one another on each fixed support as well as on each of the two pusher arms or each part of the operating member, which is itself attached to, or forms an integral part of, one of the pusher arms.

3. The switching device according to claim 1, wherein the contact piece is a rigid flat strip, and in that each of the two pusher arms is of straight elongate shape and is attached to the rigid flat strip and orthogonal thereto.

4. The switching device according to claim 1, wherein the operating member is a single piece consisting of a rod connected to a connecting beam connecting the two pusher arms.

5. Switching device according to claim 1, wherein the operating member comprises only the two pusher arms.

6. The switching device according to claim 5, wherein the contact piece comprises two openings, each formed in one of its end parts, and wherein the two pusher arms comprise hooks that can each engage in one of the two openings of the contact piece so as to form a removable joint.

7. Switching device according to claim 1, wherein the contact piece is attached to the two pusher arms by a removable joint, preferably a clip-fitting joint, or by a permanent joint.

8. The switching device according to claim 1, wherein each other end part of the at least one flexible strip is attached to each of the two pusher arms, or to each part of the operating member that is itself attached to or forms an integral part of one of the pusher arms, by a removable joint, preferably a bearing and centring joint or a clip-fitting joint.

9. The switching device according to claim 1, wherein each fixed support comprises a shaft arranged parallel to the axis of movement of the operating member.

10. The switching device according to claim 9, wherein the shaft of the support is arranged substantially orthogonally to the rigid flat contact strip.

11. The switching device according to claim 1, wherein it comprises an axially moving actuator adapted to move at least one flexible strip, called the drive strip, arranged substantially orthogonally to the axis of movement of the operating member and adapted to transmit the movements of the actuator to the two pusher arms.

12. The switching device according to claim 11, wherein it comprises a single flexible drive strip having a free end bearing against the rod of the operating member, to transmit the movements of the actuator to the two pusher arms.

13. The switching device according to claim 11, wherein it comprises two flexible drive strips, each having a free end bearing against one of the two pusher arms to transmit the movements of the actuator to them.

14. The switching device according to claim 1, wherein in the open position of the operating member, the contact piece bears on the closure plate.

15. The switching device according to claim 1, wherein each flexible strip has an external shape substantially in the form of an isosceles triangle or a parallelogram, comprising a single end part attached to a fixed support arranged on one side of the plane formed by the two pusher arms and extending orthogonally to the contact piece, each other end part of each flexible strip being attached to one of the two pusher arms.

16. The switching device according to claim 1, wherein each flexible strip has an external shape substantially in the form of a lozenge, comprising two end parts attached to a fixed support arranged in a plane perpendicular to the plane formed by the two pusher arms and extending orthogonally to the contact piece, each other end part of each flexible strip being attached to one of the two pusher arms or to a part of the operating member attached to the two pusher arms, forming a cross.

17. The switching device according to claim 1, wherein each flexible strip is in the general shape of a lozenge, comprising two end parts, each attached to a fixed support arranged in the plane formed by the two pusher arms and extending orthogonally to the contact piece, each other end of each flexible strip being attached to one of the two pusher arms.

18. The switching device according to claim 1, wherein each flexible strip has an external shape substantially in the form of a lozenge, comprising two end parts, each attached to a fixed support arranged in the plane formed by the two pusher arms and extending orthogonally to the contact piece, each other end part of each flexible strip being attached to a part of the operating member attached to the two pusher arms, forming a cross.

* * * * *